US010544030B2

(12) United States Patent
Ewing et al.

(10) Patent No.: US 10,544,030 B2
(45) Date of Patent: Jan. 28, 2020

(54) MULTI-COMPARTMENT PITCHER WITH SELECTABLE DISPENSING PORT

(71) Applicant: Samantha Ewing, St. Petersburg, FL (US)

(72) Inventors: Samantha Ewing, St. Petersburg, FL (US); Ezinne Chukwunenye, Palm Bay, FL (US); Lora Nowicki, New Port Richey, FL (US)

(73) Assignee: Samantha Ewing, St. Petersburg, FL (US)

( * ) Notice: Subject to any disclaimer, the term of this patent is extended or adjusted under 35 U.S.C. 154(b) by 0 days.

(21) Appl. No.: 16/429,133

(22) Filed: Jun. 3, 2019

(65) Prior Publication Data

US 2019/0375625 A1 Dec. 12, 2019

Related U.S. Application Data

(60) Provisional application No. 62/681,949, filed on Jun. 7, 2018.

(51) Int. Cl.
*B67D 3/00* (2006.01)

(52) U.S. Cl.
CPC ..... *B67D 3/0061* (2013.01)

(58) Field of Classification Search
USPC ..... 222/94–185.1, 495–496, 485, 510–518, 222/561, 105, 305, 306, 366
See application file for complete search history.

(56) References Cited

U.S. PATENT DOCUMENTS 1,134,865 A * 4/1915 Jones ..... F16K 21/04 251/321
1,802,359 A * 4/1931 Tone ..... B65D 47/286 222/511
1,825,895 A * 10/1931 Younghusband ..... A45D 40/02 401/62
1,919,887 A * 7/1933 Gleeson ..... A45D 40/26 401/180
2,000,818 A * 5/1935 Bomberger ..... B65D 47/286 222/142.1
2,411,489 A * 11/1946 Williams ..... A47G 19/24 222/142.8
2,626,089 A * 1/1953 Osfar ..... B65D 47/286 222/511
2,652,951 A * 9/1953 Esposito ..... B65D 47/286 222/142.1
2,666,555 A * 1/1954 Hill ..... A45D 40/26 222/340
2,683,554 A * 7/1954 Mulhauser, Jr. ... B65D 83/0409 221/152

(Continued)

*Primary Examiner* — Paul R Durand
*Assistant Examiner* — Randall A Gruby
(74) *Attorney, Agent, or Firm* — Larson & Larson, P.A.; Justin P. Miller; Frank Liebenow

(57) ABSTRACT

The disclosed device is a multi-compartment container. Each compartment is capable of holding a different liquid. The user actuates a valve to dispense the liquid of his or her choice.

The multi-compartment pitcher with selectable dispensing port eliminates spillage from the top, and eliminates fumbling over multiple and various drinks or liquids. The device compartmentalizes multiple drinks or liquids within a single container, while easily dispersing the drink or liquid from the designated bottom port.

8 Claims, 6 Drawing Sheets

(56) References Cited

U.S. PATENT DOCUMENTS

| | | | | | |
|---|---|---|---|---|---|
| 3,122,286 | A * | 2/1964 | De Luca | B65D 83/06 | 222/485 |
| 5,328,050 | A * | 7/1994 | Hyatt | B67D 3/0022 | 220/506 |
| 5,667,102 | A * | 9/1997 | Keller | B05C 17/00513 | 222/327 |
| 5,806,708 | A * | 9/1998 | Schwab | A45C 11/008 | 220/378 |
| 6,158,621 | A * | 12/2000 | Keller | B05C 17/00583 | 222/105 |
| 6,820,767 | B2 * | 11/2004 | Nicholas | A47G 19/2205 | 222/132 |
| 7,063,713 | B1 * | 6/2006 | Butsch | A61B 17/3203 | 604/22 |
| D655,562 | S * | 3/2012 | Schenk | D7/307 | |
| 9,884,753 | B1 * | 2/2018 | Juarez | B67D 3/0061 | |
| 2003/0234062 | A1 * | 12/2003 | Wei | A47J 47/01 | 141/319 |

* cited by examiner

MULTI-COMPARTMENT PITCHER WITH SELECTABLE DISPENSING PORT

RELATED APPLICATIONS

This application claims priority to provisional application No. 62/681,949, filed Jun. 7, 2018, titled Multi-compartment pitcher with selectable dispensing port.

FIELD

This invention relates to the field of liquid storage and dispensing and more particularly to a single device that holds multiple liquids, allowing a user to choose which liquid to dispense.

BACKGROUND

Beverages are an ever-present part of our waking hours. Whether it is orange juice with breakfast, water during breaks, soda with lunch, or iced tea on a warm day, drinks are a part of the day. The presence of beverages extends to social situations, such as shared meals or parties.

With multiple individuals, agreement on a single beverage is rare. Those who prefer Coke will not find root beer a fair substitute. The result is many containers on the table, each with a single beverage. Then one must pass the many containers around the table to provide each person the opportunity to choose the beverage they desire.

What is needed is a single container that will hold multiple beverages, minimizing the number of container that must be filled and passed.

SUMMARY

The disclosed device is a multi-compartment container or pitcher for liquids/drinks. Each compartment is capable of holding a different liquid. The user actuates a valve to dispense the liquid of his or her choice.

The multi-compartment pitcher with selectable dispensing port eliminates spillage from the top, and eliminates fumbling over multiple and various drinks or liquids. The device compartmentalizes multiple drinks or liquids within a single container, while easily dispersing the drink or liquid from the designated bottom port.

The multi-compartment pitcher with selectable dispensing port is comprised of four optional quadrants. Each quadrant can hold a different drink or liquid. The pitcher is equipped with two dividers, both of which are removable and adjustable. Depending on how the dividers are installed, the pitcher can be divided into two halves or four quadrants.

The multi-compartment pitcher with selectable dispensing port does not pour liquid from the top, as would a traditional pitcher, but rather it dispenses liquid from one of four bottom ports.

To dispense a liquid from a compartment, the user depresses a peg that slides within a channel. Moving the peg inward causes a fluid conduit to align with an inlet opening and a discharge opening, thereby allowing fluid to flow.

When pressure is released from the peg a spring pushes the peg outward within the channel, again blocking the path between the inlet opening and discharge opening with the solid section of the peg.

The inventors reached the disclosed design after reviewing multiple alternative designs. The most challenging structure was the mechanism to dispense liquids through the bottom port.

The inventor tried multiple handles for the pitcher, a different free-swinging chamber, an electrically-actuated option, and various other methods.

The multi-compartment pitcher with selectable dispensing port is best suited for culinary and service purposes. To be useful in such industries, the device must be safe, durable, reusable, and visually pleasing. ABS plastic is safe for kitchen appliances and usage, is thermally flexible and durable. Additionally, catering companies generally use stainless steel products for commercial uses, stainless steel is both safe for use and is durable, as well as being considered attractive.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Reference will now be made in detail to the presently preferred embodiments of the invention, examples of which are illustrated in the accompanying drawings.

Figure 1:
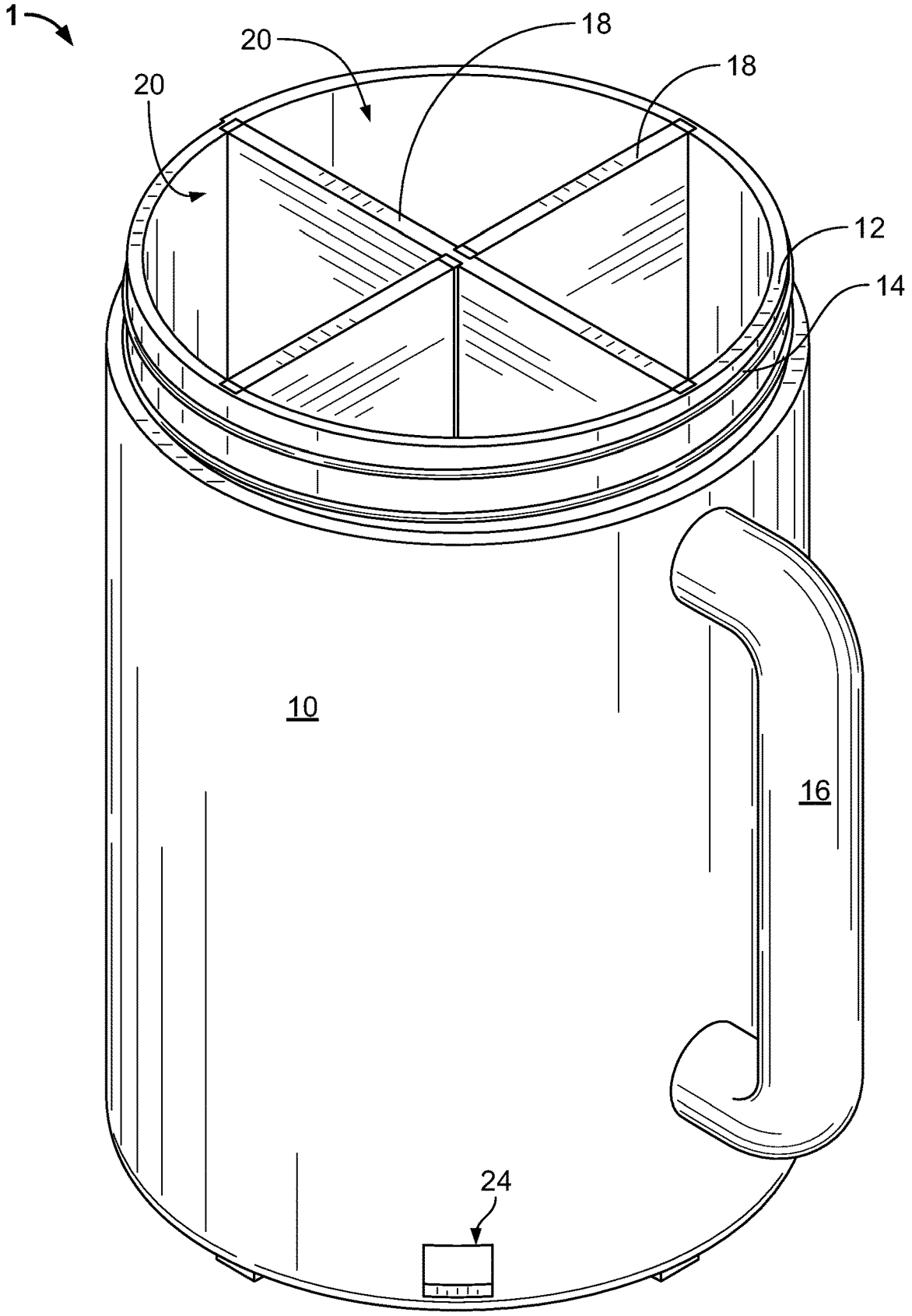
FIG. 1 illustrates a first isometric view of the multi-compartment pitcher with selectable dispensing port.

Referring to FIG. 1, a first isometric view of the multi-compartment pitcher with selectable dispensing port is shown.

The multi-compartment pitcher 1 is formed from a body 10, or outer sleeve, that includes an inner sleeve 12. The inner sleeve 12 protrudes above the body, with optional threads 14 that interface with a lid 90 (see FIG. 7).

A handle 16 helps users to lift the device.

A pair of dividers 18 separate the inner sleeve 12 into chambers 20. The figure shows an arrangement of four chambers/compartments, but other numbers of chambers/compartments are possible.

An actuation port 24 is visible, through which a user places a finger to dispense the desired liquid.

Figure 2:
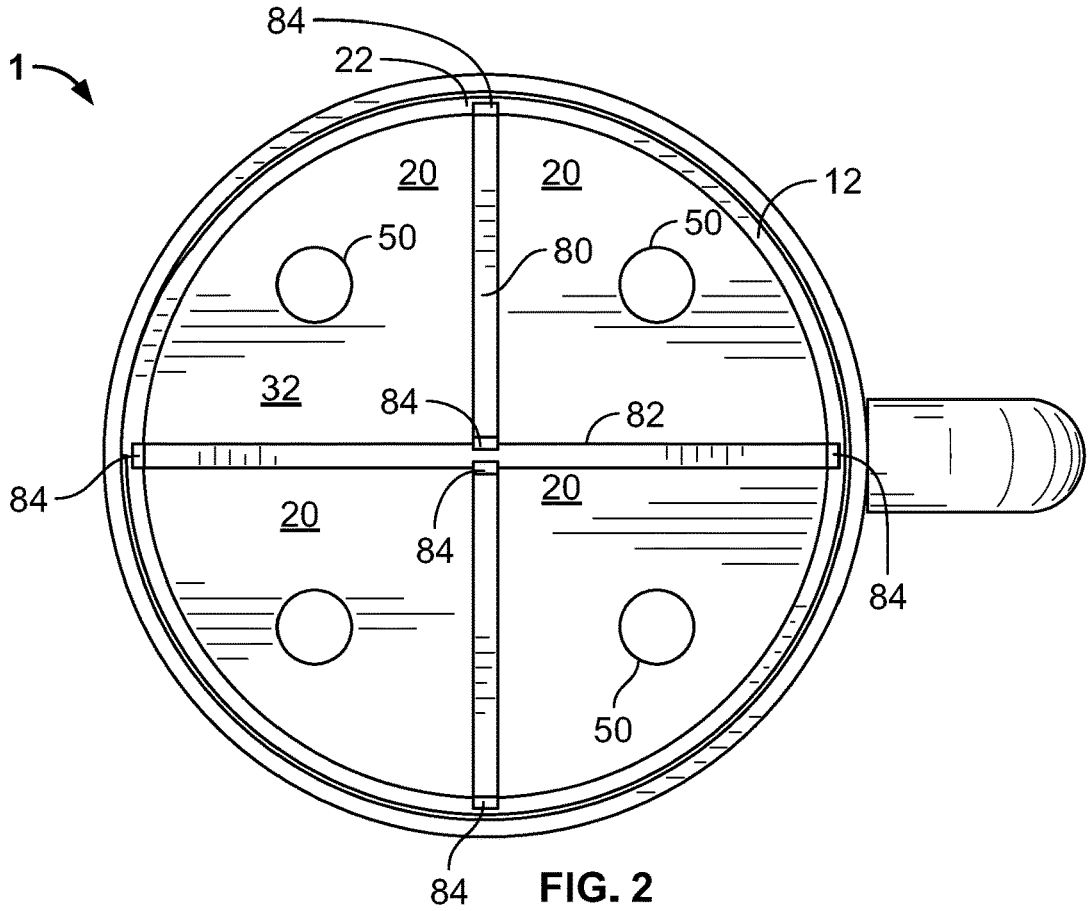
FIG. 2 illustrates a top view of the multi-compartment pitcher with selectable dispensing port.

Referring to FIG. 2, a top view of the multi-compartment pitcher with selectable dispensing port is shown.

The dividers 18 (see FIG. 1) are shown formed from a first divider 80 and a second divider 82. Each divider 80/82 includes associated seals 84. The seals 84 create a liquid-tight connection between the dividers 80/82 and the vertical slots 22 within the inner sleeve 12, as well as between the first divider 80 and the second divider 82.

Also visible are the inlet openings 50 through the upper plate 32, each within a chamber 20.

Figure 3:
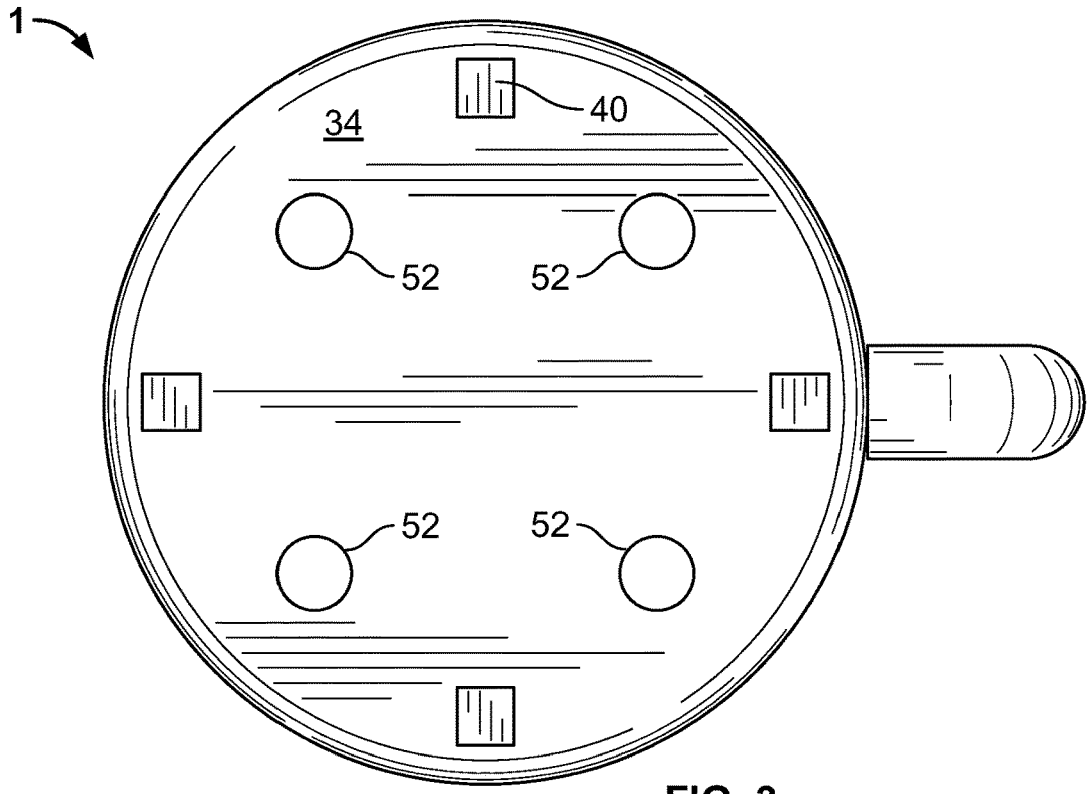
FIG. 3 illustrates a bottom view of the multi-compartment pitcher with selectable dispensing port.

Referring to FIG. 3, a bottom view of the multi-compartment pitcher with selectable dispensing port is shown.

The discharge openings 52 are visible within the lower plate 34, and feet 40.

Figure 4:
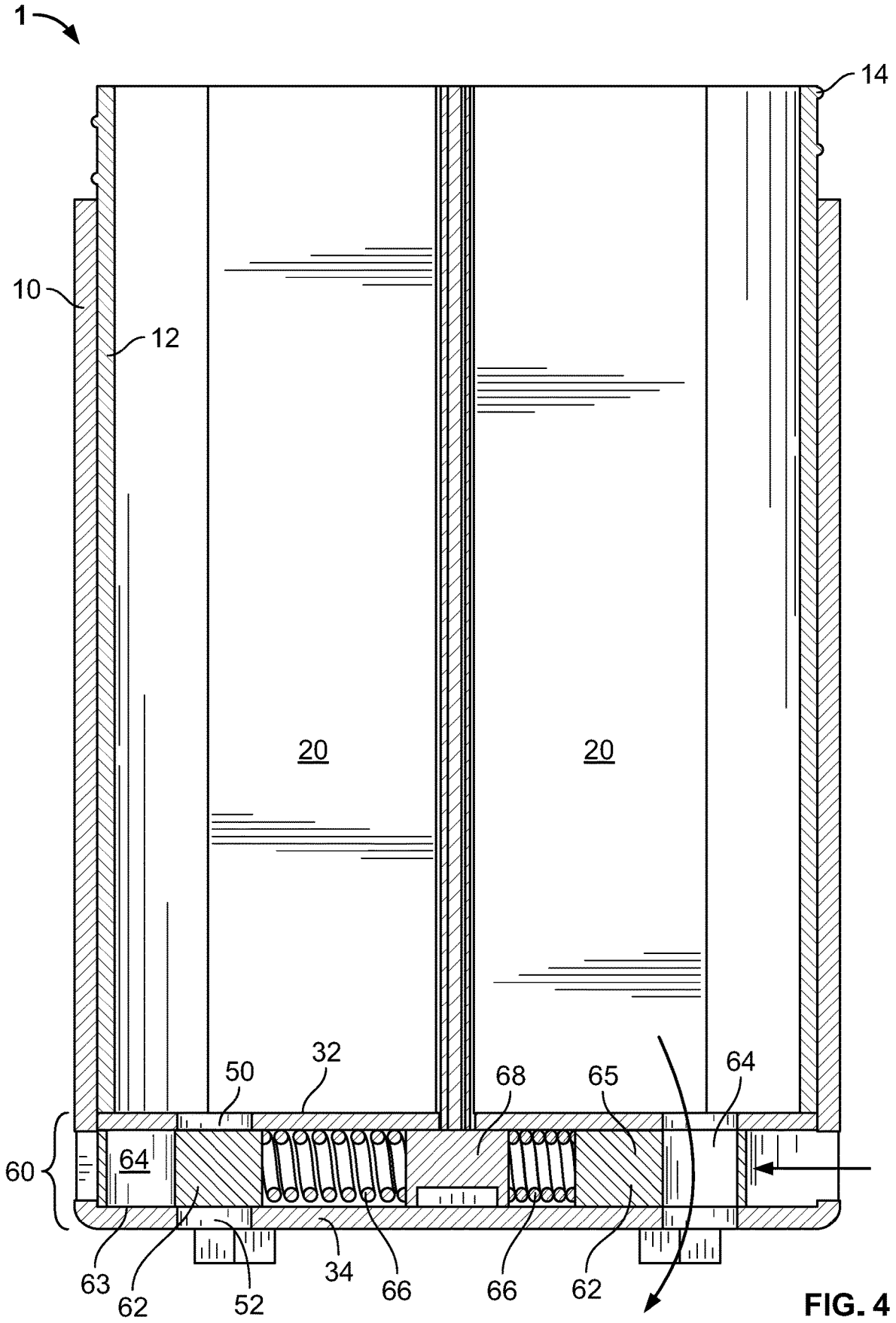
FIG. 4 illustrates a vertical cross-section of the dispensing section of the multi-compartment pitcher with selectable dispensing port.

Referring to FIG. 4, a vertical cross-section of the device of the multi-compartment pitcher with selectable dispensing port is shown.

For each fluid to be dispensed, the dispensing mechanism 60 includes a peg 62 that slides within a channel 63 formed between the upper plate 32 and the lower plate 34.

Each peg 62 includes a fluid conduit 64 and a solid section 65.

When the peg 62 is pressed, the peg 62 slides along the channel 63, aligning the fluid conduit 64 with the inlet opening 50 and discharge opening 52. This allows fluid to flow out of the chamber 20.

When the peg 62 is released, the spring 66, which is braced against the stationary member 68, pushes the peg 62, placing the solid section 65 between the inlet opening 50 and discharge opening 52, thereby blocking the flow of fluid.

Figure 5:
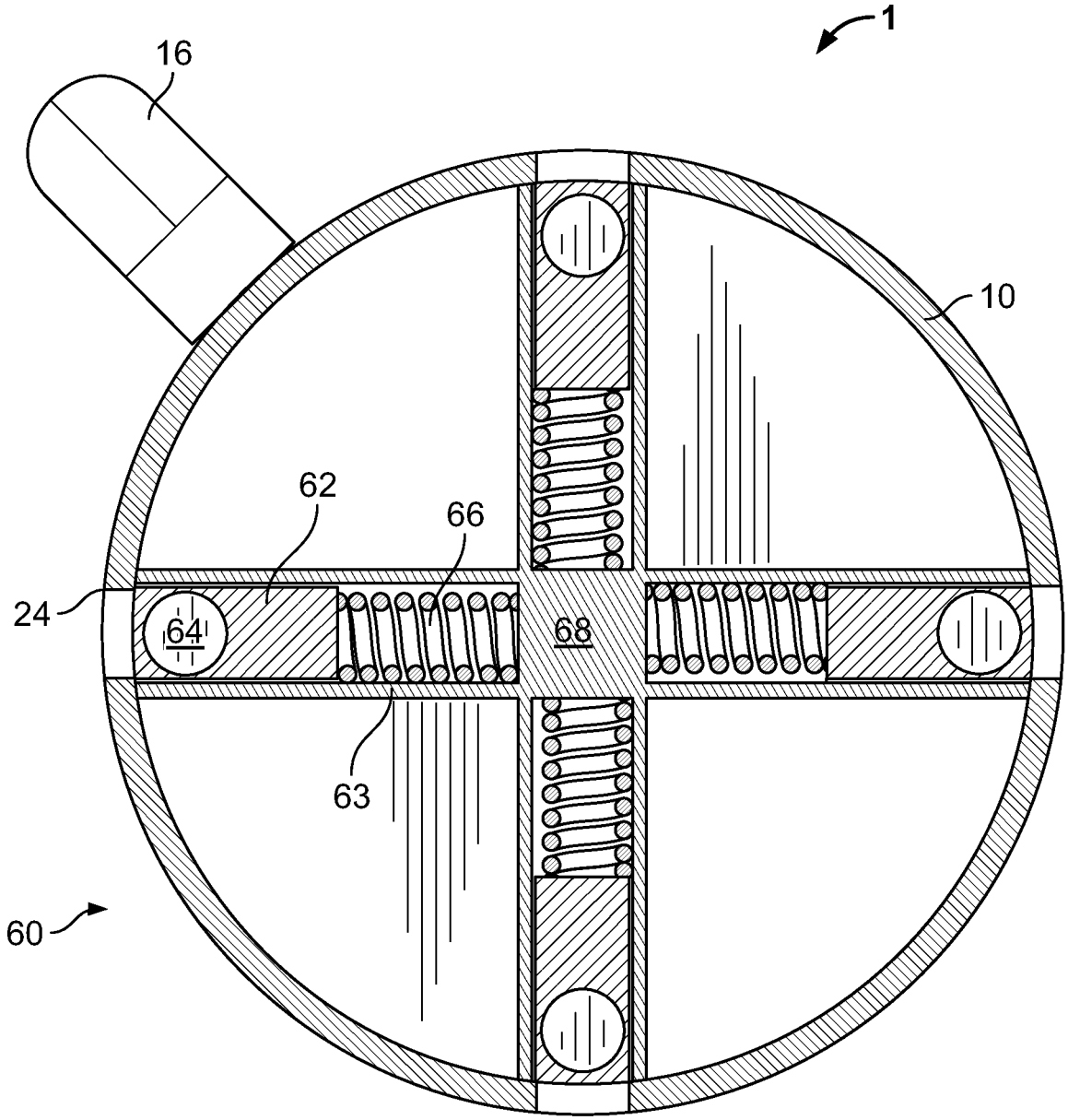
FIG. 5 illustrates a horizontal cross-section of the device of the multi-compartment pitcher with selectable dispensing port.

Referring to FIG. 5, a horizontal cross-section of the dispensing section of the multi-compartment pitcher with selectable dispensing port is shown.

The body 10 is shown with dispensing mechanism 60. A user reaches through the actuation port 24 to contact the peg 62. Pressing peg 62 causes peg 62 to inward within the channel 63, compressing spring 66, aligning fluid conduit 64 to allow fluid to exit the chamber 20. The spring 66 is braced against stationary member 68.

Figure 6:
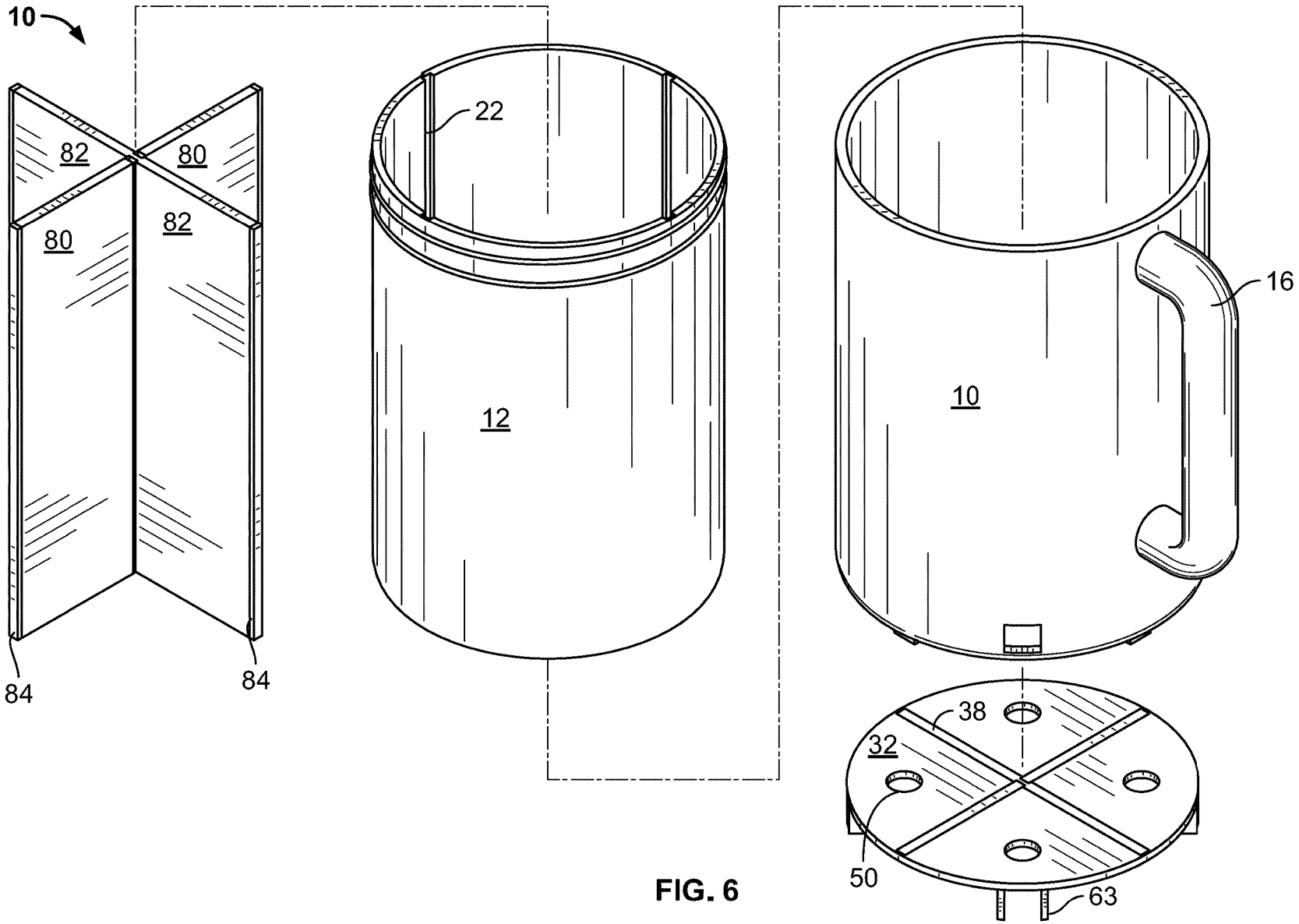
FIG. 6 illustrates an exploded view of the primary components of the device of the multi-compartment pitcher with selectable dispensing port.

Referring to FIG. 6, an exploded view of the primary components of the device of the multi-compartment pitcher with selectable dispensing port is shown.

The dividers 18 comprise first divider 80 and second divider 82, each with seals 84.

The body 10 includes an optional inner sleeve 12, the inner sleeve 12 with vertical slots 22 to hold the dividers 18.

A handle 16 simplifies interaction with a user.

The upper plate 32 includes horizontal slots 38 that interface with the dividers 18. Multiple inlet openings 50 are visible.

A channel 63 is visible beneath the upper plate 32.

Figure 7:
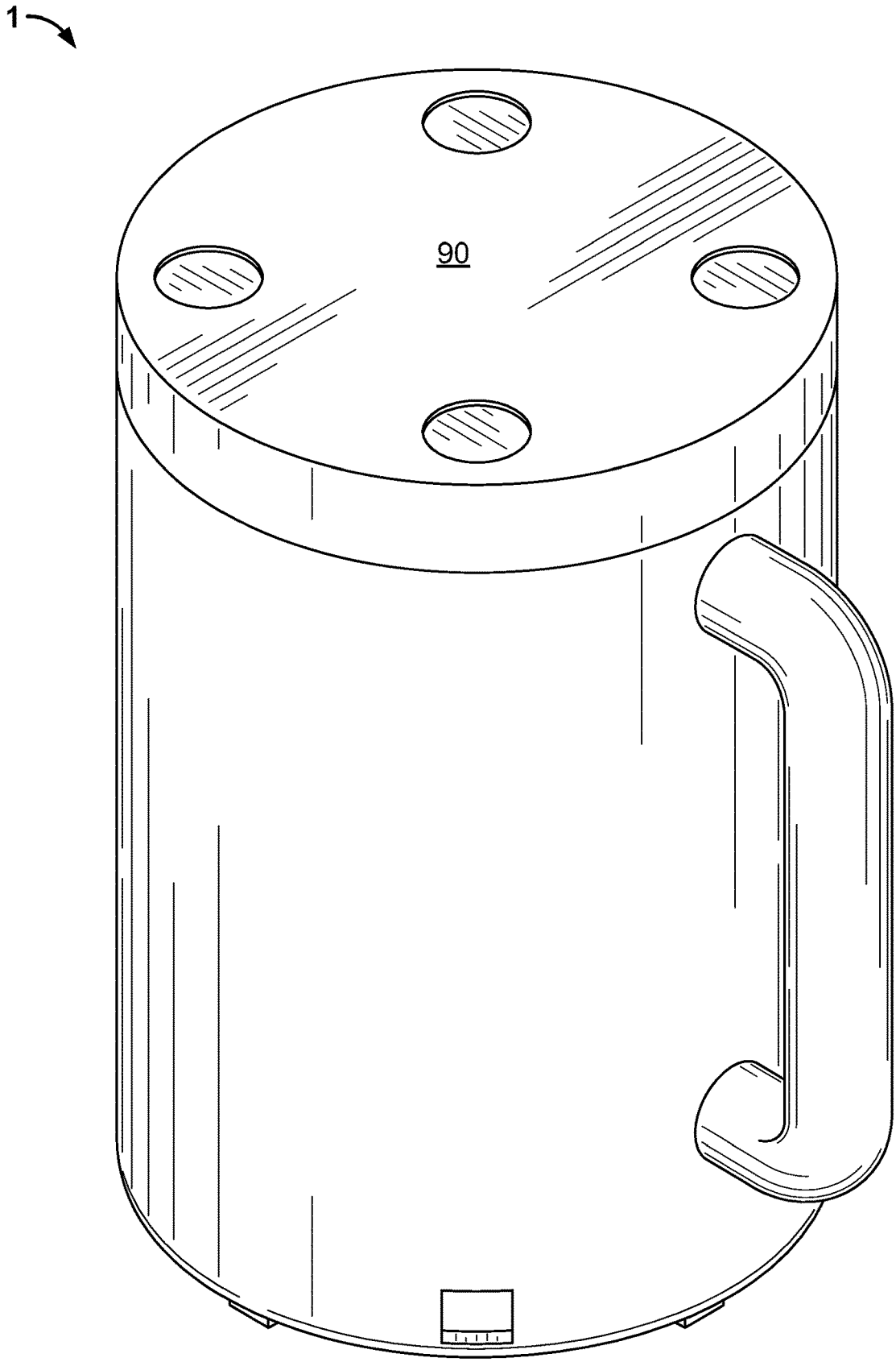
FIG. 7 illustrates an assembled view of the device of the multi-compartment pitcher with selectable dispensing port.

Referring to FIG. 7, an assembled view of the device of the multi-compartment pitcher with selectable dispensing port is shown.

The lid 90 is shown, covering the multi-compartment pitcher 1.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A drink pitcher with multiple compartments, the drink pitcher comprising:
- a first compartment;
- a second compartment;
- a dispensing mechanism associated with each of the first compartment and the second compartment;
- each dispensing mechanism formed from:
  - a peg;
  - a channel, the peg sliding within the channel;
  - the peg having:
    - a first position that prevents a liquid from exiting from its respective compartment;
    - a second position that allows a liquid to exit from its respective compartment:
  - an upper plate and a lower plate; and
- an outer sleeve and an inner sleeve, wherein the inner sleeve protrudes above the outer sleeve and the upper plate is contained within the outer sleeve;
- whereby a user may select the liquid, and then dispense from the first compartment or second compartment.

2. The drink pitcher of claim 1, further comprising:
- a third compartment;
  - the third compartment including a dispensing mechanism;
- a fourth compartment;
  - the fourth compartment including a dispensing mechanism;
- whereby the user may select from the first, second, third, or fourth compartment when dispensing a liquid.

3. The drink pitcher of claim 2, further comprising:
- a first divider and a second divider;
  - the first divider and second divider locking together in a perpendicular arrangement;
  - the combination of the first divider and the second divider separating a single compartment into the first compartment, second compartment, third compartment, and fourth compartment.

4. The drink pitcher of claim 1, further comprising:
- a divider;
  - the divider separating a single compartment into the first compartment and second compartment.

5. The drink pitcher of claim 1, further comprising:
- a body surrounding the first compartment and the second compartment.

6. A pitcher for liquids, the pitcher separately containing multiple liquids, the pitcher comprising:
- two or more compartments;
- each of the two or more compartments able to separately dispense a liquid;
- each of the two or more compartments including an associated dispensing mechanism;
- whereby a user can select the liquid and activate the associated dispensing mechanism;
- wherein each associated dispensing mechanism comprises:
  - a peg formed from a solid section and a fluid conduit;
    - the solid section blocking fluid flow;
    - the fluid conduit allowing and guiding fluid flow;
  - a channel in which the peg slides;
  - a stationary member;
  - a spring between the peg and the stationary member;
    - the spring resisting motion of the peg from a closed position to an open position;
    - the spring returning the peg to the closed position;
    - the closed position positioning the solid section to block flow:
    - the open position positioning the fluid conduit to allow flow;
- whereby a user can select a compartment from which to dispense a liquid and thus activate the associated dispensing mechanism; and, the pitcher further comprising an outer sleeve and an inner sleeve, wherein the inner sleeve protrudes above the outer sleeve and the upper plate is contained within the outer sleeve.

7. The drink pitcher of claim 6, further comprising:

a divider;

the divider separating the two or more compartments from each other.

8. The drink pitcher of claim 7, further comprising:

a first divider and a second divider;

the first divider and second divider locking together in a perpendicular arrangement;

the combination of the first divider and the second divider separating the pitcher into a first compartment, a second compartment, a third compartment, and a fourth compartment.

* * * * *